United States Patent [19]

Halford

[11] 4,195,629

[45] Apr. 1, 1980

[54] FACE MASK

[75] Inventor: George C. Halford, Mentor, Ohio

[73] Assignee: Halbrand, Inc., Willoughby, Ohio

[21] Appl. No.: 493,707

[22] Filed: Jul. 31, 1974

Related U.S. Application Data

[63] Continuation of Ser. No. 83,544, Oct. 23, 1970, abandoned.

[51] Int. Cl.[2] ..... A62B 7/00

[52] U.S. Cl. ..... 128/206.13

[58] Field of Search ..... 128/146.2, 146, 146.3–147, 128/205, 163, 137, 140 R; 2/206

[56] References Cited

U.S. PATENT DOCUMENTS

| | | | |
|---|---|---|---|
| 843,486 | 2/1907 | Otto | 2/206 |
| 1,292,096 | 1/1919 | Schwartz | 128/146.2 |
| 2,458,580 | 1/1949 | Fisketti et al. | 128/146.2 |
| 2,494,406 | 1/1950 | Reitano | 128/146.2 |
| 3,042,034 | 7/1962 | Gruenewaelder | 128/146.2 |
| 3,101,709 | 8/1963 | Gruenewaelder | 128/146.2 |
| 3,220,409 | 11/1965 | Liloia et al. | 128/146.2 |

*Primary Examiner*—Dalton L. Truluck
*Attorney, Agent, or Firm*—Frank B. Robb

[57] ABSTRACT

The invention disclosed herein relates to face masks which are formed of a polyurethane foam material which is designed to be easily positioned upon the face of the wearer, of light weight without ties but depending upon the formation of certain openings to slip over ears. The mask is furthermore of a free breathing type and without tendency to fog. Additionally, by reason of the construction a filter pad of non-woven rayon fiber may be used to increase the filtration and at the same time not markedly affect audibility in use.

6 Claims, 4 Drawing Figures

FACE MASK

This application is a continuation of application Ser. No. 83,544 filed Oct. 23, 1970, now abandoned.

OBJECTS OF THE INVENTION

It is a principal object of this invention to provide a face mask which can be autoclaved and is formed of a foam material which is light in weight, facilitates connection and mounting on the face of a wearer to at the same time assure complete covering of the oral and nasal passages.

It is a further object of this invention to provide a face mask of the class described wherein the body thereof is arranged to have a filtration area which may be varied in filtration factor in accordance with any desired criteria by incorporating therein a predetermined number or quantity of filter discs of non-woven rayon fiber material.

A further object of the invention is to provide a face mask wherein the same is formed with unique openings for supporting the mask on the ears of the wearer in such a manner as to assure that the filtration area completely covers and is in close proximity with the oral and nasal passages, and yet will not substantially interfere with audibility or breathing.

Another object of the invention is to provide a face mask which is of relatively simple construction, inexpensive to manufacture, may be disposed of after use if necessary or, in the alternative autoclaved and reused and positioned on the face of a wearer very quickly without ties or concern for slipping by reason of the unique construction hereof.

Other and further objects of the invention will be understood from a consideration of the specification appended hereto and disclosed in the drawing wherein.

DESCRIPTION OF THE INVENTION

Figure 1:
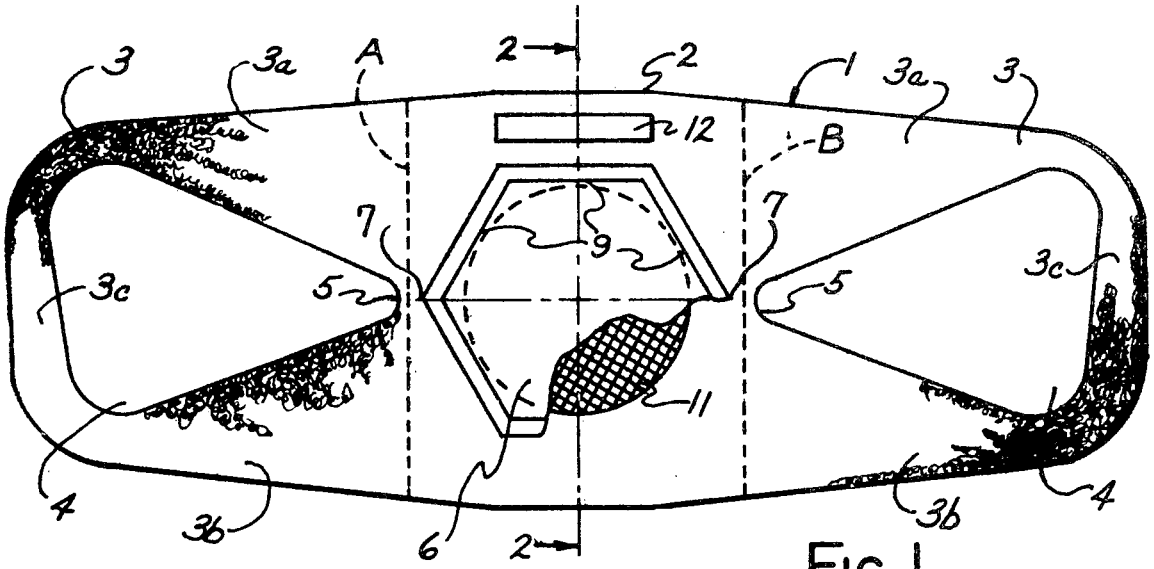
FIG. 1 is a plan view of the face mask, having a portion in section to illustrate the filtering area and particularly disclosing the configuration of the ear openings therein.

Referring to FIG. 1, the face mask hereof is shown as comprising an elongated body generally designated 1, formed of a non-rigid polyurethane foam sheet material preferably, about one-eighth of a inch thick.

The body 1 is comprised of a section designated 2 to cover generally the oral and nasal passages of a wearer of the mask, the section 2 being delineated for the purposes of this description by the dotted lines A and B.

The dotted lines A and B divide the central section 2 from the ear piece members designated 3, these being identically formed so as to incorporate therein the triangular shaped openings 4. The openings 4 are not true triangles because the apices of all the angles are rounded as indicated, but in any event apices 5 face each other and are near the lines A and B and thus of the central section 2.

Figure 2:
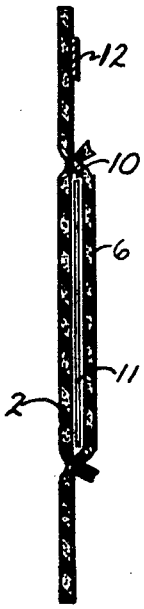
FIG. 2 is an enlarged sectional view taken about on the line 2—2 of FIG. 1, looking in the direction of the arrows.

Referring to FIG. 2 in conjunction with FIG. 1, the central section 2 as illustrated has adhered to the face thereof, a cover member generally designated 6 which in this instance is hexagonal in shape with the apices of the hexagonal configuration indicated at 7, about opposite the apices 5 of the triangular openings 4 previously mentioned.

Figure 3:
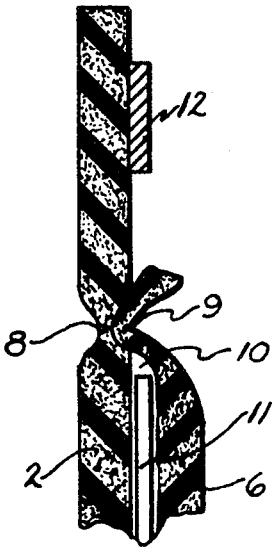
FIG. 3 is a greatly enlarged fragmentary sectional web to illustrate the manner of sealing of the cover member on the body of the mask.

Since the material of which this mask is formed is a polyurethane foam and the cover member 6 is to be adhered thereto, the same is effected by heat sealing so as to make a connection substantially as indicated in FIG. 3, and denoted at 8, this applying to each of the sides of the hexagonal member, the lines 9 in FIG. 1 indicating where the sealing is effected, this causing a deformation at the point of sealing as will be readily appreciated by those familiar with this type of arrangement.

The cover member 6 is applied in such a manner as to provide a pocket 10 between the member 6 and the central section 2. The pocket 10 is designed to have supported therewithin a disc 11 suggested in FIG. 1, as being round in general configuration and of about the same size as the cover member 6, but retained in position therewithin by the sealed connection suggested at 9 as previously described.

The foam material of the body and of the cover member is best described as being an 80-pore material, non-rigid in nature and as previously suggested about one-eighth inch thick.

The filter disc 11 is comprised of a non-woven rayon fiber which weighs 45 grams per square yard.

It should be understood that whereas there is a single disc 11 shown in the FIG. 3 disclosure, it is within the scope of this invention to provide more than one such disc where the filtration factor is desired to be varied in proportion thereto.

Suitably affixed above the cover member 6 and to the body and specifically in the section 2 thereof, is a rectilinear piece of dead foil tape which is provided with a pressure sensitive back and suitably positioned thereby upon the face of the section 2 about as illustrated and designated at 12.

Figure 4:
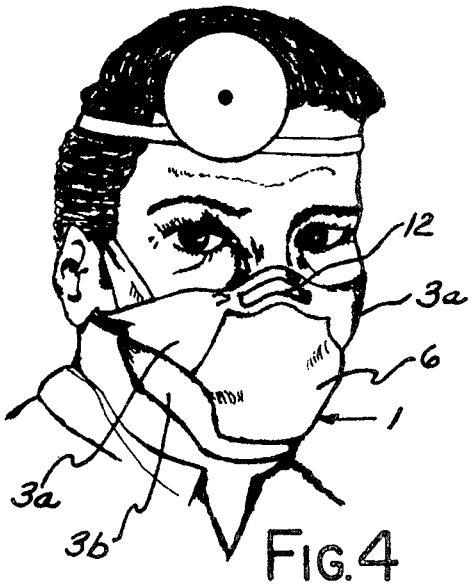
FIG. 4 is a view illustrating the manner of applying the mask to the face of a wearer and further illustrating the novel form of ear piece members to carry out the object of the invention.

Referring now to FIG. 4, the mask body 1 hereof is shown in place on a wearer and specifically over the oral and nasal passages thereof, with the cover member 6 forming a sort of cup-shaped arrangement by reason of the unique concept of twisting the upper portions of the ear pieces 3, designated specifically at **3*a*, so as to overlie the lower portions 3*b* of the ear pieces and cling to and extend along the sides of the face of the wearer, thence under the ears at the lobes thereof and over the tops of the ears respectively with the end portions of the ear piece members 3 designated 3*c*** behind the ears.

Because of the stretchability of this polyurethane material, the section 2 will also extend under the chin of the wearer to assist in positioning the same for complete enclosure of oral and nasal passages. Conceivably even a somewhat less resilient material could be molded to provide a similar effect, with flexible ear pieces formed and connected as described.

It will therefore be seen that the areas alongside, and specifically the cheek and jaw areas will be covered by this peculiar overlapping arrangement, and at the same time the central portion of the cover member 6, and thus of the section 2 thereunder, will be too tightly forced against the mouth and nose but providing a sort of bulge at the portions indicated in FIG. 4 at 6.

The pressure sensitive foil nose piece 12 is bent so as to form to the nose configuration, and at the same time prevent unfiltered air from passing alongside the nose into the area of the oral and nasal passages.

I claim:

1. A face mask of the class described, when disposed on the face of a user, comprising a generally rectilinear, relatively thin, normally flat, uniform thickness plastic foam material body, having a central section covering the oral and nasal passage areas of the face of a user, a pair of earpiece members extending from the central section, each of said members having a generally triangular opening therein, certain of the apices of said openings being closely adjacent the central section aforesaid, whereby triangular areas of the body alongside the said openings provide the connection of the central section with the earpiece members, the ears of the user extending through the openings and said triangular areas on each side being twisted into overlapping relationship, causing the central section to conform closely to the chin and nose of the user of such mask, and the portions of said triangular openings at said apices providing a looser positioning of the mask material at said apices, and more close conformance to facial contours spaced therefrom toward the ears of such user.

2. The combination as claimed in claim 1, wherein the central section of the body is provided with a member of an area to cover a substantial portion of said section, said cover member being fastened to said area around the edges of said cover member.

3. The combination as claimed in claim 2, wherein the cover member in position provides a pocket in which a disc of air filtering material is loosely positioned, said disc being thinner than the space between the cover member and the body.

4. The connection as claimed in claim 2, wherein the body and the cover member are formed of 80 pore non-rigid polyurethane foam.

5. The combination as claimed in claim 1, wherein the extremities of the earpiece members comprise relatively straight, thin areas, said areas being positionable behind the ears of a wearer of the mask and the portion of the triangular area therealong being substantially the length of the connection of a wearer's ears with the head of such wearer.

6. The combination as claimed in claim 3, wherein the disc of air filtering material is of non-woven rayon fiber.

* * * * *